US005878643A

United States Patent [19]

Hwang

[11] Patent Number: 5,878,643

[45] Date of Patent: Mar. 9, 1999

[54] CURL TYPE SANDWICH AUTOMATIC CUTTING DEVICE

[76] Inventor: Ber-Fong Hwang, 1F, No. 1-1, La. 30, Sec. 1, Yan-Chi, Taipei, Taiwan

[21] Appl. No.: 844,785

[22] Filed: Apr. 22, 1997

[51] Int. Cl.[6] ..... B26D 3/11; B26D 7/01

[52] U.S. Cl. ..... 83/781; 83/410; 83/783; 83/699.31; 83/932

[58] Field of Search ..... 82/79; 144/209.1, 144/212, 213, 365; 83/781, 932, 733, 410.7, 410.8, 410.9, 783, 786, 699.21, 699.31, 648, 410

[56] References Cited

U.S. PATENT DOCUMENTS

| | | | |
|---|---|---|---|
| 1,670,076 | 5/1928 | Milbourn | 144/209.1 |
| 2,156,645 | 5/1939 | Waller | 83/733 X |
| 2,315,761 | 4/1943 | Ahrndt | 83/786 X |
| 2,601,877 | 7/1952 | Van Dam | 83/781 X |
| 4,811,776 | 3/1989 | Bolton et al. | 144/365 X |
| 4,901,777 | 2/1990 | Koike | 144/209.1 X |
| 5,141,038 | 8/1992 | Nakaya | 144/213 |
| 5,191,824 | 3/1993 | Rathbun, Jr. | 83/410.7 X |
| 5,267,498 | 12/1993 | Miyamoto et al. | 83/781 |
| 5,400,841 | 3/1995 | Holbert | 144/365 X |
| 5,419,381 | 5/1995 | Fisher | 144/209.1 X |

FOREIGN PATENT DOCUMENTS

| | | | |
|---|---|---|---|
| 411927 | 6/1934 | United Kingdom | 83/786 |
| 496069 | 11/1938 | United Kingdom | 83/786 |

*Primary Examiner*—M. Rachuba
*Assistant Examiner*—Charles Goodman
*Attorney, Agent, or Firm*—Bacon & Thomas, PLLC

[57] ABSTRACT

The present invention is related to a curl type sandwich cutting device which is comprised of a lift means, a cutting means, a feeding means and a rotation means; a chassis which may be controlled to rise and descend is installed on the body frame. The right and left flat surfaces are on the two ends of said body frame and are higher than the body frame, the lead device of a jig saw means is located across the flat surfaces, by the rotation of a motor and the swing of a jib arm of an eccentric arm, the jig saw may move left and right continuously. A rotation means is installed on the adjacent side, by chain wheel and other components to drive the axle rod of said cutting means, the jig saw may revert 180 degrees. The bottom of said chassis has installed a guiding screw and a nut which are controlled by a motor so as to move forward. A feeding device is installed on the chassis, and the feed device has a lead bar to control the bread box to rotate 360 degrees. Therefore, by the cutting action of the jig saw, the rising and descending of said lift means and the rotation of the bread box, the curl sandwich may be made from sliced bread.

3 Claims, 11 Drawing Sheets

CURL TYPE SANDWICH AUTOMATIC CUTTING DEVICE

BACKGROUND OF THE INVENTION

1. Field of the Invention

The present invention is related to the design of a curl type sandwich automatic cutting device, especially to a device which may be used to cut a bread to form a material for a curl type sandwich.

2. Description of the Prior Art

The conventional sandwich is made with bread slices, the outer crusts of which have been cut off, and then meat, butter, and vegetable salad are placed within a plurality of said bread slices, further, they are pressed together to form a sandwich.

However, in this kind of sandwich, in which the materials are placed between a plurality of bread slices, when bitten by the eater, the materials may possibly extend outward and drop out, thus dirtying the clothes of the eater, and meanwhile eater's mouth may be dirtied, the design of the conventional sandwich is not a proper design. By use of the new method and the curl type sandwich automatic cutting device of the present invention, these defects may be improved vastly.

SUMMARY OF THE INVENTION

Accordingly, the main object of the present invention is to provide a curl type sandwich automatic cutting device, wherein a rectangular slice of bread is cut, and the soft portion of the center thereof may be taken out and the outer crust is discarded, and meanwhile the cut bread is formed as a curled enveloped material, therefore, it is convenient to be flattened for use with other material, such as meat, salad, etc.

The present invention is related to a curl type sandwich cutting device The right and left flat surfaces are installed on the two ends of a body frame and are higher than the body frame, a lead device of a jig means is located across the flat surfaces, by the rotation of a motor and the swinging of a jib arm of a eccentric arm, a jig saw may move left and right continuously; a chassis which may be controlled to rise and descend slowly is installed on the bottom of the two flat surfaces, the bottom of the chassis is installed with a guiding screw and a nut to use as a lift means which may be driven by a motor to attain the function of rising and descending. Small gears and a lead bar are pivotally fixed on predetermined points on said chassis, and which are pressed by a positioning frame to form a feeding means. A rotation means is installed on the adjacent side of the cutting means, by chain wheel and other components to drive the axle rod of said cutting means. Thus, the jig saw may revert 180 degrees.

The lift means, cutting means and feeding means are operated simultaneously, and the action of the jig saw means is controlled in proper timing to match the positive and negative reverting actions of the feeding means so that the material within said bread slices may be cut and taken out to form a curl sandwich material. Thus the sandwich may be mass produced.

The invention, as well as its many advantages, may be further understood by the following description and drawings in which:

DETAILED DESCRIPTION OF THE PREFERRED EMBODIMENT

Figure 1:
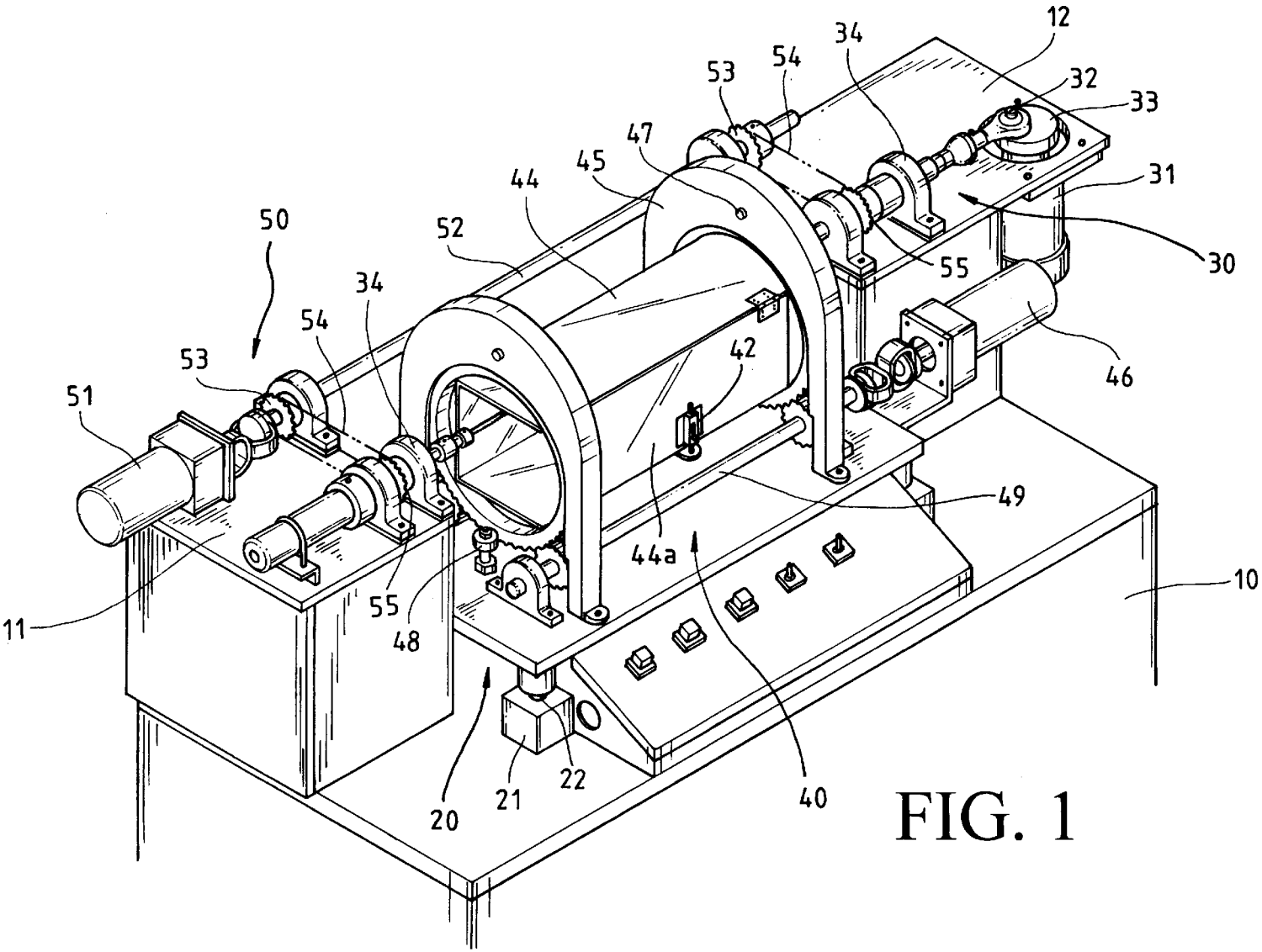
FIG. 1 is the respective view of the embodiment of the present invention.
Figure 2:
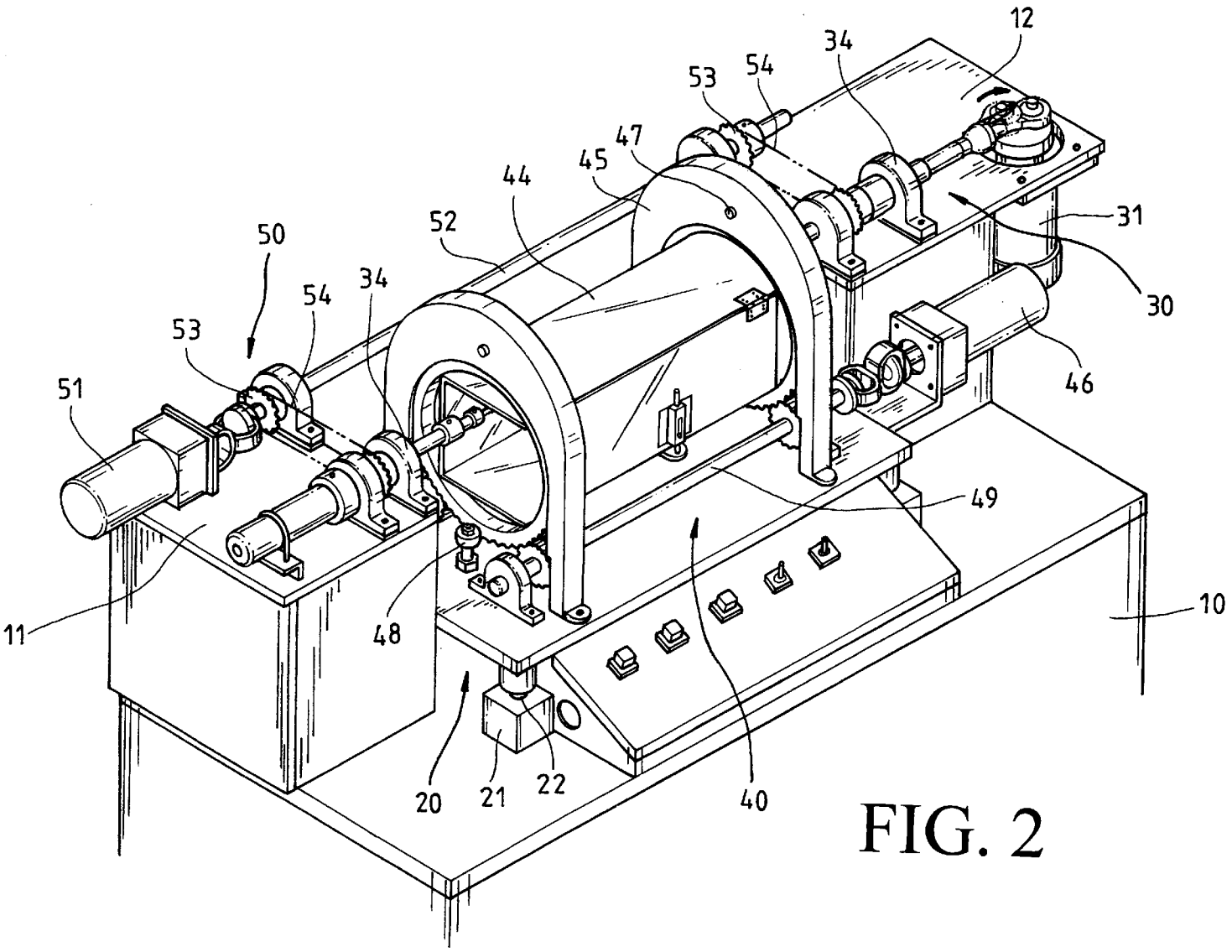
FIG. 2 is the appearance of FIG. 1, which shows the rightward and leftward movements of the cutting means.
Figure 3:
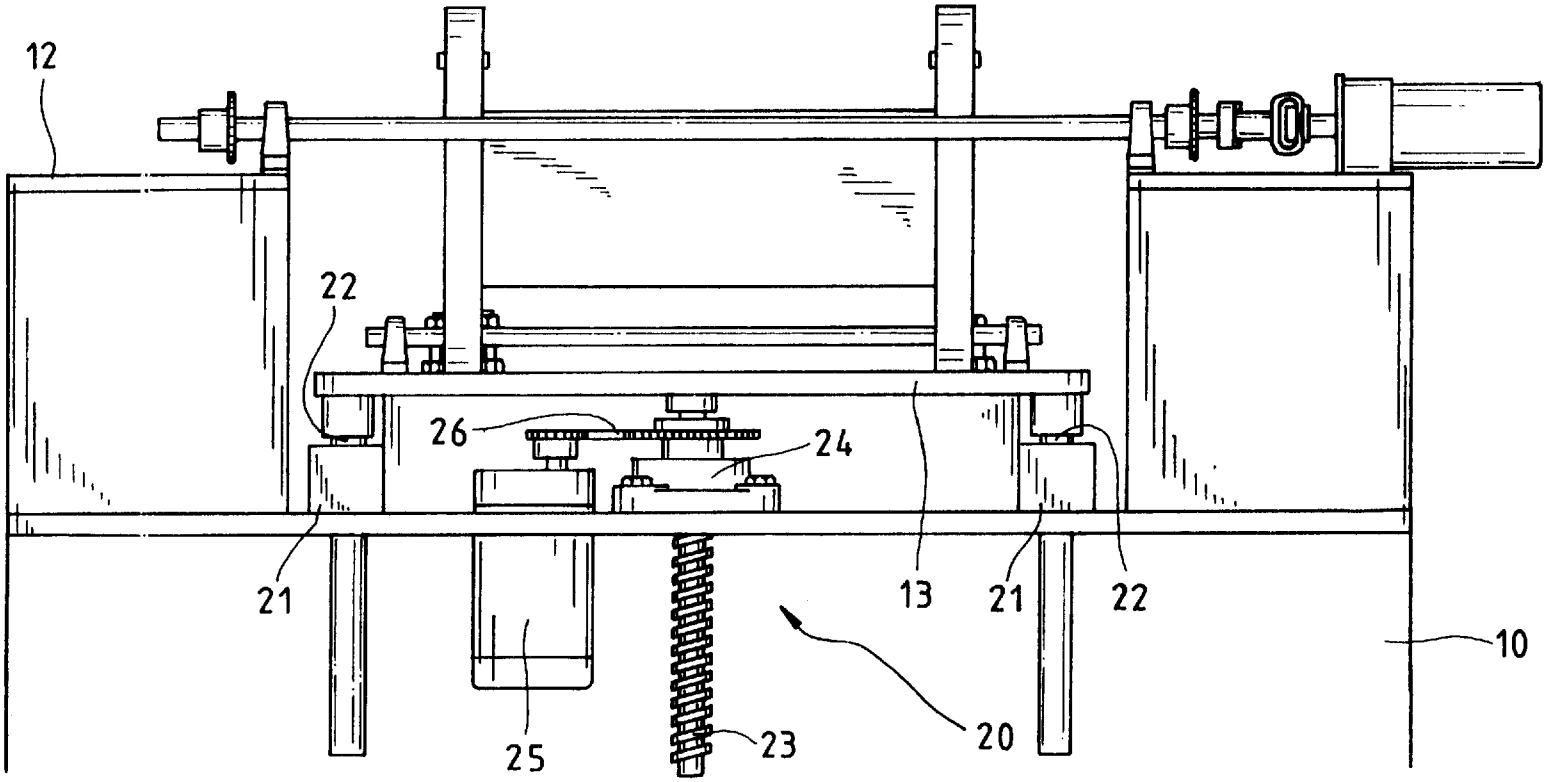
FIG. 3 is the rear side view of the present invention, wherein the lift means has not been actuated.
Figure 4:
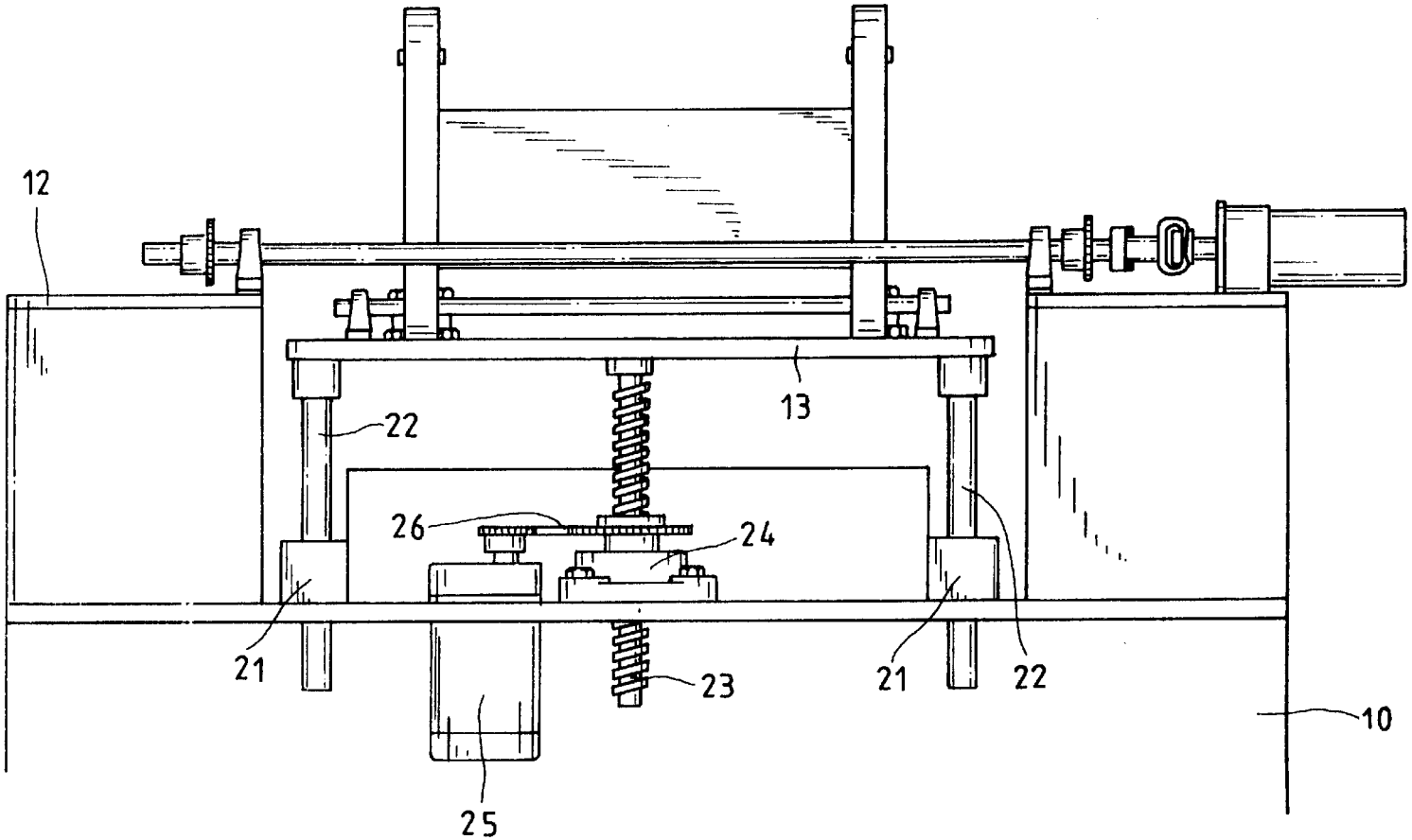
FIG. 4 is the rear view of FIG. 3, wherein said lift means has been actuated.

Now referring to FIG. 1, the curl type sandwich automatic cutting device is mainly comprised of a body frame 10, the two sides of which are installed with a left and a right flat surfaces 11 and 12. The cutting device itself contains a lift means 20 (referring to FIG. 3 and 4), a cutting means 30, a feeding means 40 and a rotation means 50.

Wherein, the lift means 20 as shown in FIGS., 3 and 4 is installed on the bottom of the chassis 13 of said body frame 10, a fixing stand 21 is installed on the four corners of said chassis 13, and a polished positioning slide bar 22 is installed and connected on the position of said fixing stand. A guiding screw 23 which is vertically extended downwards is installed on the center of the bottom of a flat plate, while a screw base 24 is fixedly installed on the body frame 10. A lift driving motor 25 is installed on one side of the screw base 24. A chain wheel is pivotally fixed on the rotary axle of the motor. A chain stay 26, which may be driven to rotate, is engaged with said screw base 24 for rotation so that the chassis 13 may be electrically controlled to rise or descend slowly.

Figure 7:
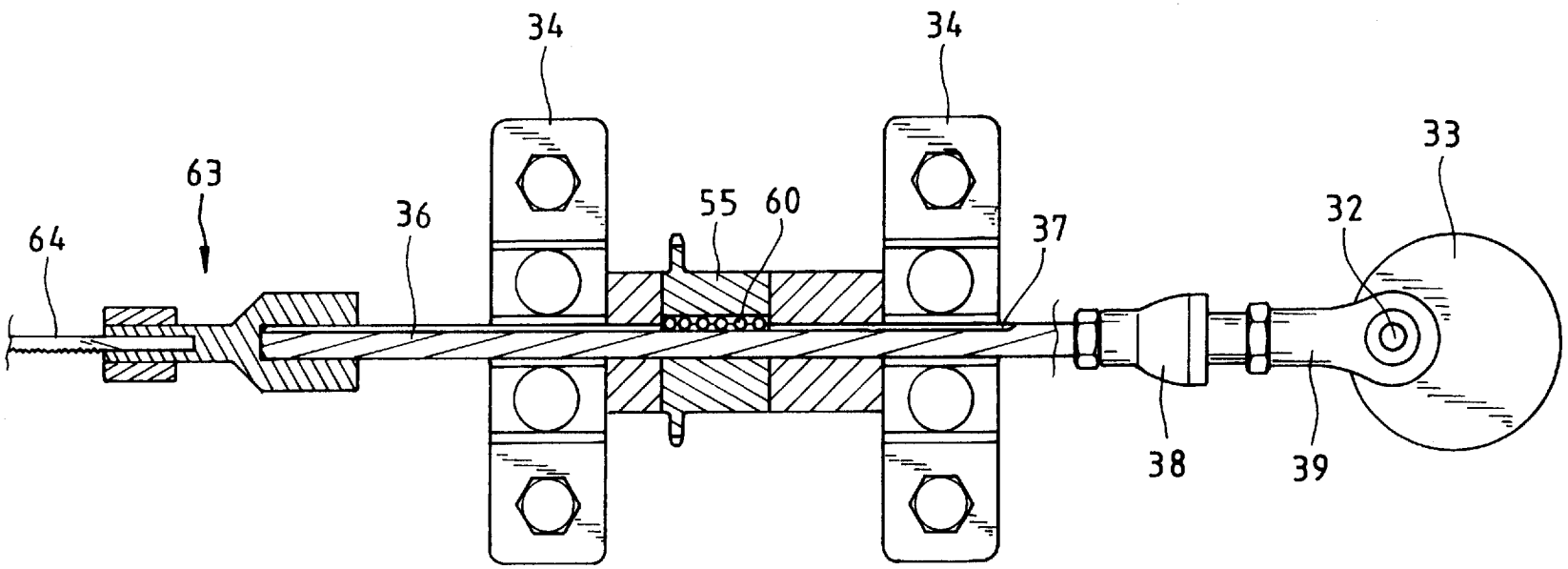
FIG. 7 is the sectional cross section view showing the structure of the front end on the cutting means of the present invention.
Figure 8:
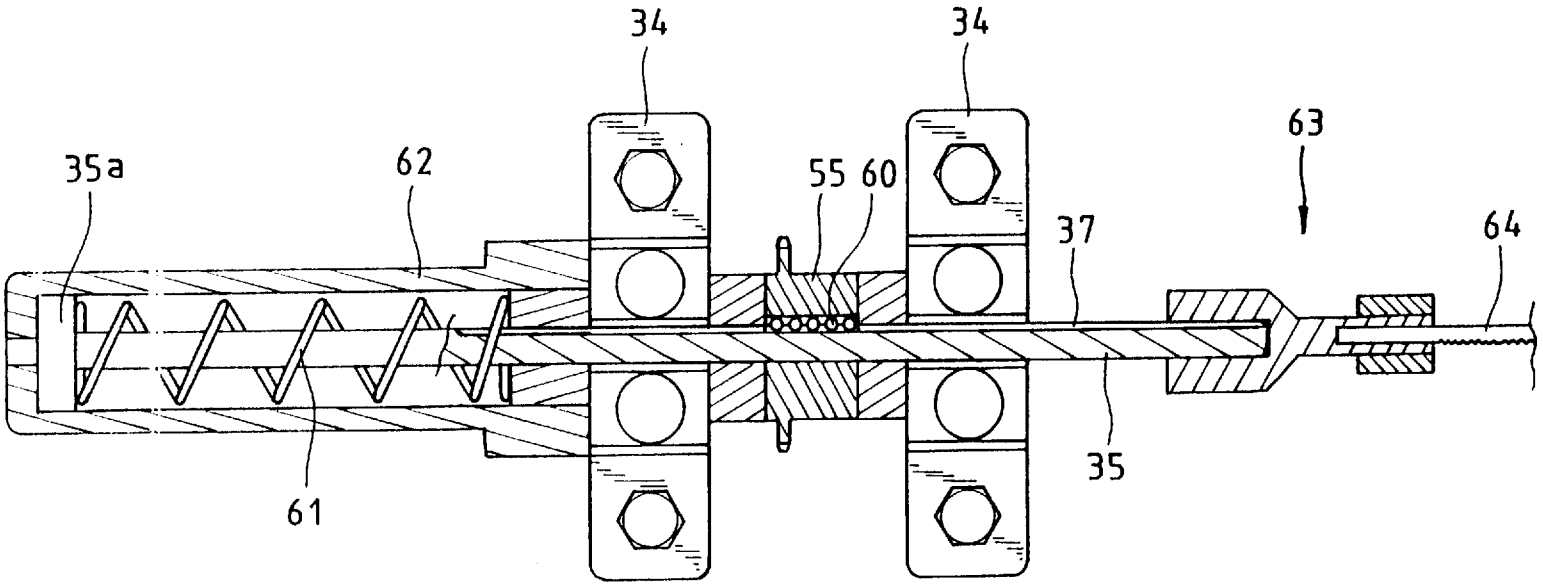
FIG. 8 is the sectional cross section view showing the structure of the distal end on the cutting means of the present invention.

Said cutting means 30 (referring to FIGS. 1, 7, and 8) is installed between the flat surfaces 11 and 12 of the left and right ends of said body frame. A cutting driving motor 31 is installed on the plate of said right flat surface 12, and a rotary wheel 33 having an eccentric shaft 32 is pivotally fixed on a rotary axle of said motor. A plurality of bearing bases 34 are fixedly mounted on the flat surfaces 11 and 12. Drag rods 35 and 36 (referring to FIG. 6), having axial steel bar slots 37, extend are through the bearing base 34 of said left and right flat surfaces 11 and 12. A universal connector 38 which is between the wheel 33 and the bearing base 34 is connected on the end of said right side drag bar 36. By connecting the eccentric shaft 32 with an arm 39, when the cutting driving motor is rotated, said arm 39 is driven by circular rotation of the eccentric shaft 32 of the wheel 33 to circularly rotate, and by the guiding of said universal connector 38 directly move said drag bar 36. Thus, said drag bar is directly and repeatedly moved on said bearing base 34. On the other hand, the distal end of said left drag bar 35 on the left flat surface 11 has a stop block 35*a* providing resistance with a revert spring 61, which has a sleeve 62 for securely covering and preventing fingers of a user from being clamped. A chucking device 63 is installed on each end of said feeding means near the centers of the two drag rods 35 and 36 (referring to FIG. 6, which will be described hereinafter) so that the two ends of a jig saw blade 64 may be fixedly clamped therebetween, such that the jig saw blade 64 extends through a bread box 44 of a feeding means 40.

Figure 6:
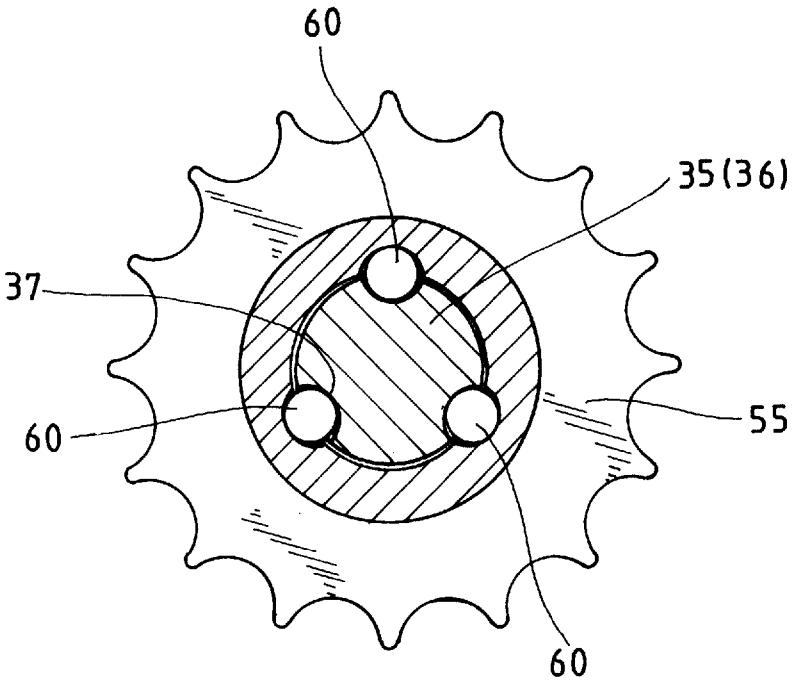
FIG. 6 is a schematic view showing the combination of the drag rod and chain wheel of the present invention.

Now referring to FIG. 1 and 6, first set of chain wheels 55 is axially pivotal on the medium portion of the two left and right drag rods 35 and 36, and via a chain 54 engaging the first set of chain wheels 55 of the chain wheels are provided with rolling steel balls 60. Normally, the drag rods 35 and 36 may be linearly and axially extended. When the second set of chain wheels 53 is rotated simultaneously by the rotation of a driving motor 51 to drive the drag rods 35 and 36 via a chain 54 engaging the first set of chain wheels 55, the steel balls 60 within chain wheels are radially buckled thus, the cutting piece may be rotated through 180 degrees, thereby providing a rotation means 50.

Figure 9:
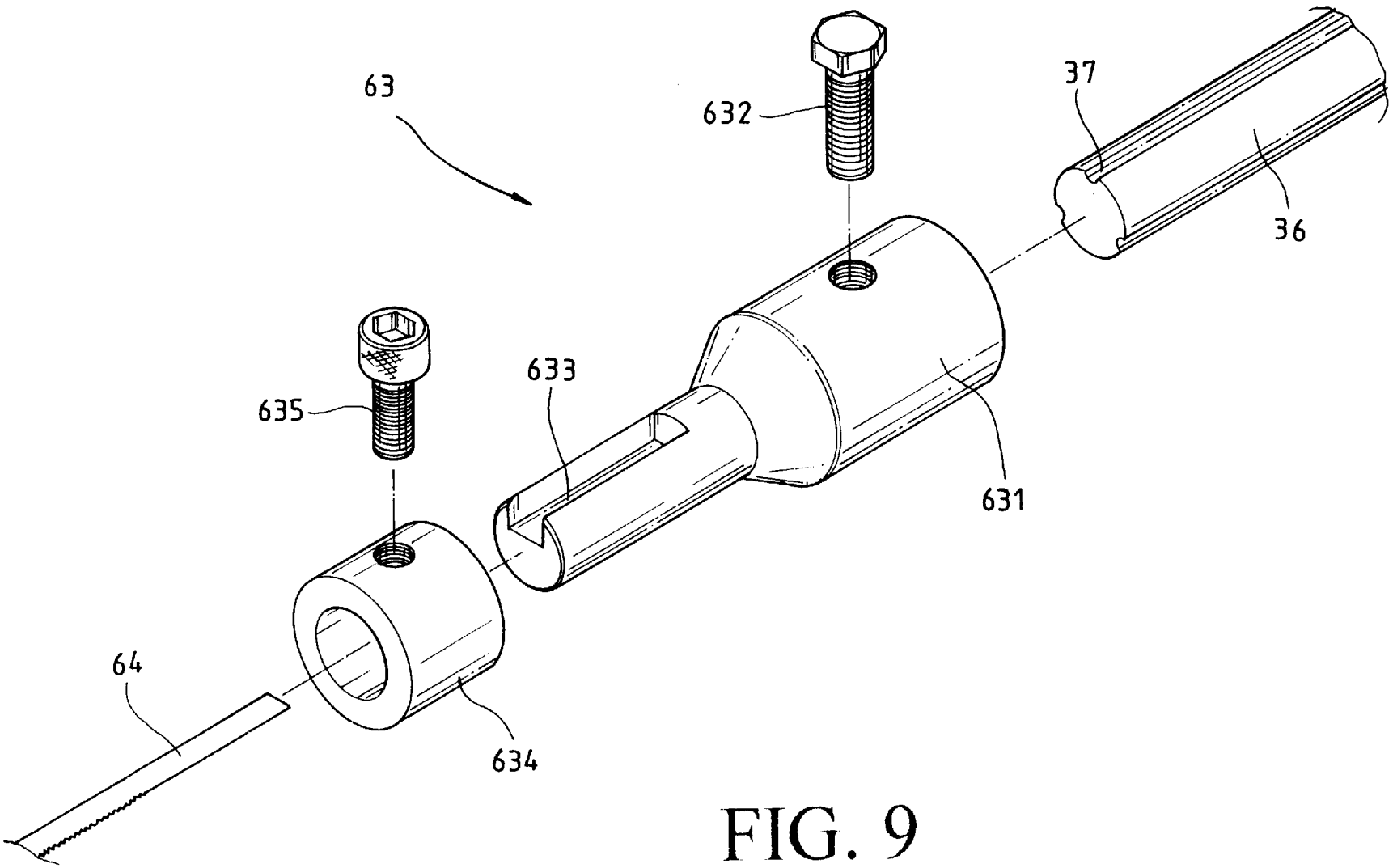
FIG. 9 is the structural exploded view of the chucking device in the present invention.

Referring to FIG. 9, the aforementioned chucking device 63 comprises a shaft mouth 631 having a rear end for penetration by the rod end of the drag rods 35 or 36; they are combined by the radial fixing screw 632. Furthermore, on the axial radius of the other end of the shaft mouth 631, a groove 633 is installed. A fixing screw 635 is radially installed on a ring 634. If the jig saw blade 64 is placed into said groove 633, the fixing screw can be screwed tightly to fix said jig saw blade. It is appreciated that as installing said jig saw blade 64 and one end thereof is fixedly connected a chucking device 63, another end thereof will be fixedly locked after the drag rod 35 is dragged outward so that the revert spring has an elastic force after being pressed. Thus, after the jig saw blade 64 is well installed, said jig saw is tightly extended. For the cutting means 30, by the pulling and Pushing actions from the rotating arm 39 on the eccentric shaft 32 of the wheel 33, the long jig saw will not be curved or broken due to the inertial force induced from the reversing displacement of said means, as the revert spring 61 tightly extends the jig saw.

Figure 5:
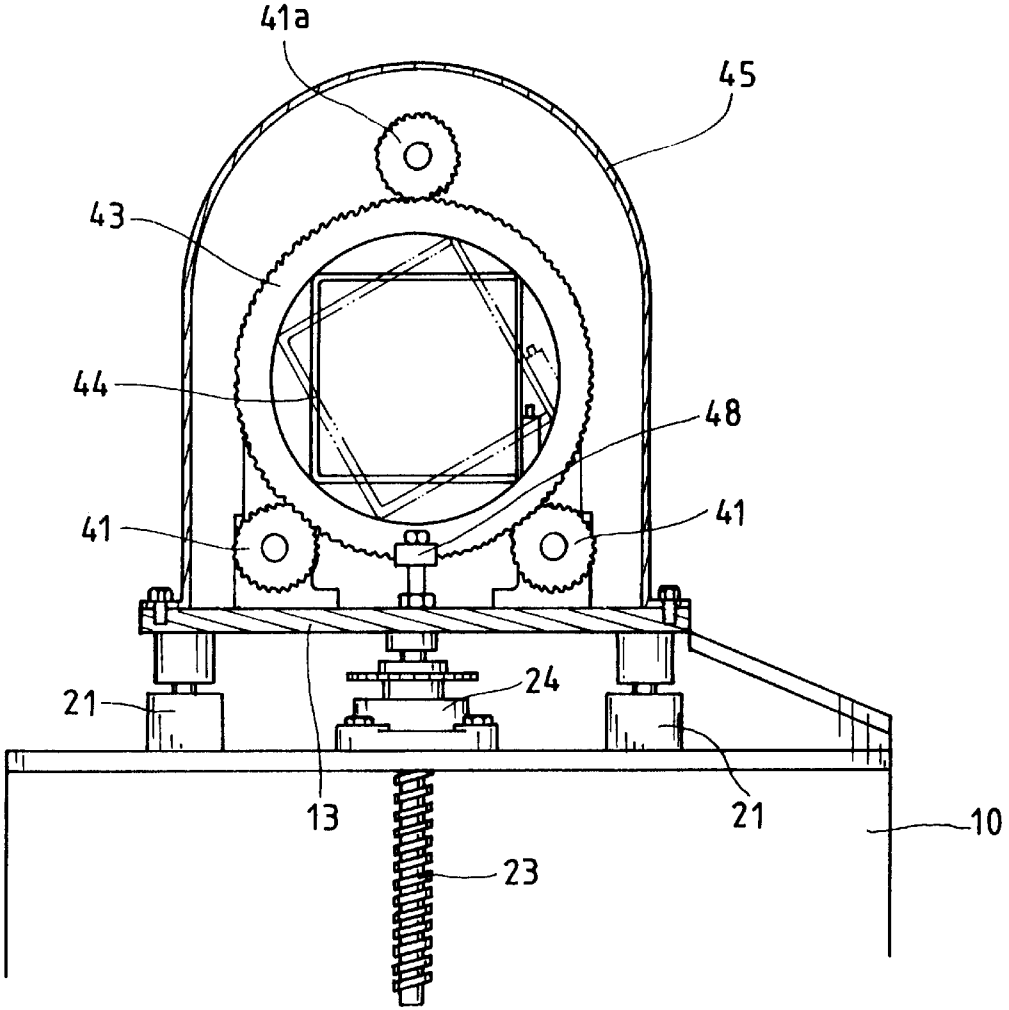
FIG. 5 is the side cross sectional view of the present invention, which shows the structure of a feeding means.

Now referring to FIGS. 1 and 5, the feeding means of the present invention is pivotly fixed on the chassis 13 by at least one little gear 41 and a guide rod 49 so that it is installed around a bread box 44 having a large gear 43, which could be guided by another little gear 41. The gears are covered by two positioning frames 45, and a small gear 41*a* is fixed on the pivotal axle 47 on the positioning frames 45. Gears 41 and 41*a* together engage and position the large gear around the bread box. Further, a limited rolling wheel 48 on one side is used to prevent the large gear from shifting sidewards. The rotation of the bread box may be controlled by a guide rod 49 of a feed driving motor 46. Further, the bread box 44 includes a door 44*a* on a side thereof and a latching means 42 mounted thereon.

Figure 10:
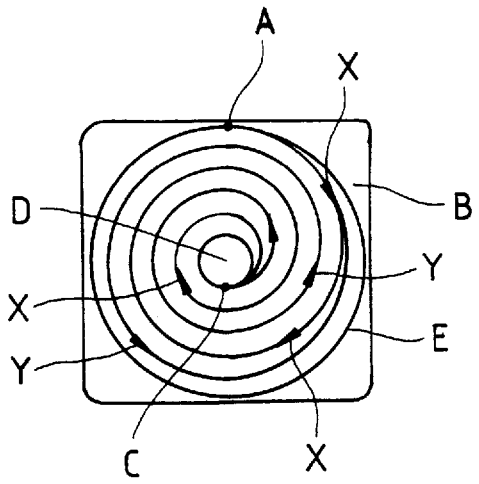
FIG. 10 shows the path of the cutting jig saw of the present invention.
Figure 11:
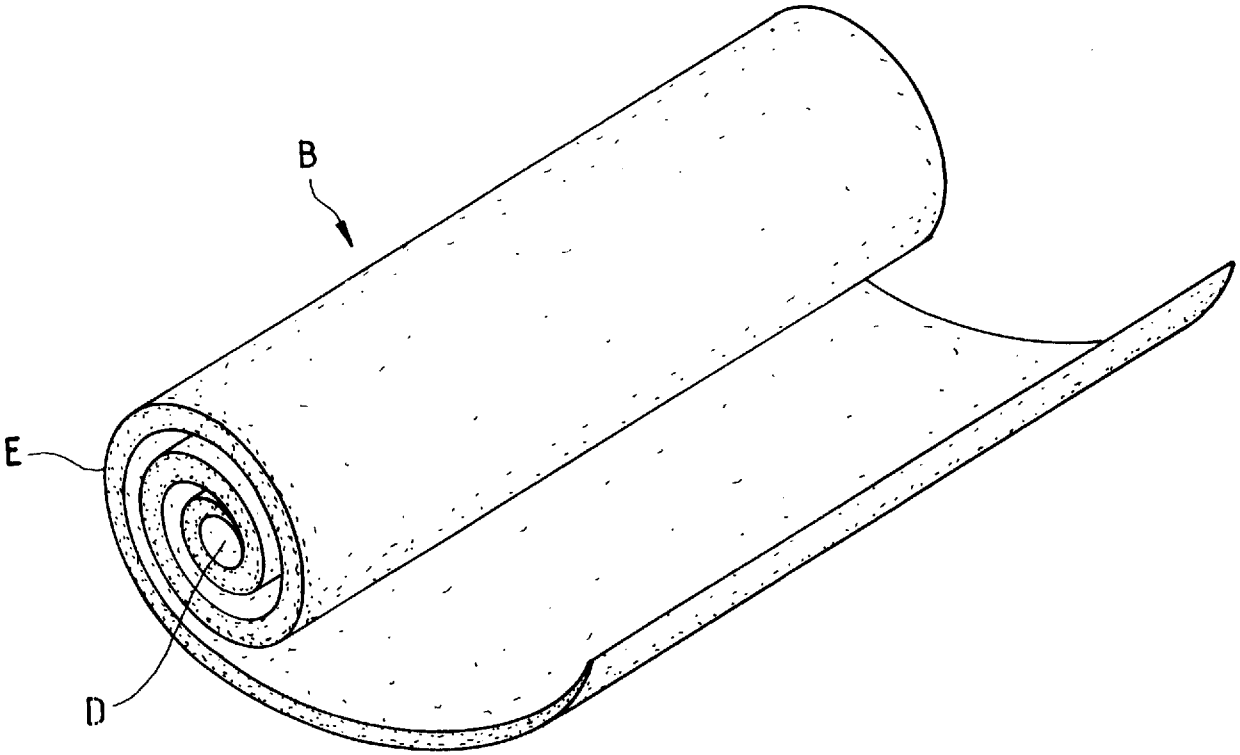
FIG. 11 shows the appearance of the curl sandwich material which is cut by using the device of the present invention.

FIG. 10 shows the path of the jig saw of the jig saw blade of the present invention. The original point A of the jig saw 64 is on the center of said bread box, and the bread slice B is contained within said bread box 44. By using an associated circuit to actuate the cutting means 30, the jig saw will continuously move forward and backward, on the other hand, the lift means 20 is actuated simultaneously, and the feeding means is positively rotated so that the bread box 44 will clamp the bread slice B to rise upwards and rotated simultaneously on said chassis 13. Therefore, the jig saw is moved forward as shown in the direction of the arrow X (now the teeth of the jig saw face forward). When the teeth cut near the center point C, the lift means will be stopped, a cylinder D is cut from the center of bread slice B, and then further make the jig saw 64 again stop near the center C, then the feeding means 40 is stopped, and drive a rotation means 50 in order that the jig saw 64 is reversed (180 degrees) on a predetermined point, then the feeding means 40 is reversed as well as moved forward, and the lift means 20 descends, then the jig saw of the jig saw blade cuts the bread along the direction shown by arrow Y. After the jig saw arrives at the original point A, the lift means is stopped, but the feeding means is still actuated, a ring path E on the bread B will be cut. After cutting, referring to FIG. 11, the curl type bread sandwich material may be made by the present invention.

Accordingly, in the present invention, the lift means 20, cutting means 30, and feeding means 40 are actuated simultaneously, and the rotation means 50 is properly controlled and is matched with the positive and negative rotations of said feeding means, thus the jig saw may cut the bread slice in the bread box to form a curl type sandwich material. Thus a cylindrical bread material may be cut easily. However, after the curl type sandwich has been made, all kinds of bread accessories are held therebetween, when biting, they will be contained within the sandwich, and not dropped out. Many changes and modifications in the above described embodiment of the invention can, of course, be carried out without departing from the scope thereof. Accordingly, to promote progress in science and the useful arts, the invention is disclosed and is intended to be limited only by the scope of the appended claims.

What is claimed is:

1. An automatic cutting device for forming a curl shaped type sandwich, said automatic cutting device comprising:

a body frame having left and right flat surfaces and a chassis installed therebetween, said chassis being supported on a plurality of fixing stands;

a lift means installed on a bottom of said chassis, said lift means including a guiding screw, a nut threadedly engaging said guiding screw, and a lift driving motor arranged to indirectly drive said nut so as to raise and lower said chassis via said guiding screw;

a cutting means installed between said right and left flat surfaces, said cutting means including a cutting driving motor disposed on one of said flat surfaces, said cutting driving motor having a rotary axle, a rotary wheel having an eccentric shaft disposed thereon, said wheel being pivotally fixed on said rotary axle of said cutting driving motor, a plurality of bearing bases fixedly mounted on said flat surfaces, left and right drag rods extending through said bearing bases on said left and right flat surfaces, respectively, at least one of said drag rods having at least one axial steel slot, a universal connector connected to a distal end of one of said drag rods located between said wheel and a respective bearing base, said universal connector being pivotally connected to said eccentric shaft of said wheel, a jig saw blade fixedly clamped between said drag rods, a stop block provided at a distal end of the other one of said drag rods, a revert spring biasing said stop block in a direction away from said jig saw blade, and a sleeve securely covering said revert spring to prevent fingers of a user from being clamped;

a feeding means pivotally fixed on said chassis by at least one little gear and at least one guide rod, said feeding means including a feed driving motor arranged to rotate said at least one guide rod and said at least one little gear, and a bread box having a large gear installed on a periphery thereof, said large gear being fixedly engaged with said at lease one small gear to be rotated thereby, said jig saw blade extending through said bread box; and a rotation means installed on one side of said cutting means for reversibly moving said jig saw blade 180 degrees, said rotation means including a chain rod extending across said left and right flat surfaces, at least one chain wheel disposed on said chain rod, said at least one of said drag rods of said cutting means also having a chain wheel disposed thereon, said chain wheel of said at least one of said drag rods having an inner part filled with steel balls that engage with said at least one axial steel slot, said chain wheel of said at least one of said drag rods being arranged to rotate with rotation of said at least one chain wheel of said chain rod, and a rotation driving motor for rotating said at least one said chain wheel of said chain rod such that rotation timing and rotation angle of said jig saw blade is controlled thereby;

wherein said lift means, said cutting means and said feeding means act simultaneously, and said jig saw blade is properly controlled by said rotation means to cut bread material within said bread box and form a curl sandwich material.

2. An automatic cutting device according to claim 1, wherein said left and right flat surfaces are located at opposite ends of said body frame and are disposed higher than said chassis.

3. An automatic cutting device according to claim 1, wherein said bread box of said feeding means includes a door on a side thereof for receiving bread material of proper size therein and includes a latching means mounted thereon for opening and closing said door.

* * * * *